US007708525B2

(12) United States Patent
Cherolis et al.

(10) Patent No.: US 7,708,525 B2
(45) Date of Patent: May 4, 2010

(54) INDUSTRIAL GAS TURBINE BLADE ASSEMBLY

(75) Inventors: Anthony Cherolis, East Hartford, CT (US); Jesse Christophel, Manchester, CT (US); William Abdel-Messeh, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 648 days.

(21) Appl. No.: 11/167,445

(22) Filed: Jun. 27, 2005

(65) Prior Publication Data

US 2007/0009359 A1 Jan. 11, 2007

Related U.S. Application Data

(60) Provisional application No. 60/654,770, filed on Feb. 17, 2005.

(51) Int. Cl.
*F01D 5/08* (2006.01)

(52) U.S. Cl. ..... 416/97 R; 416/193 A

(58) Field of Classification Search ..... 416/97 R, 416/193 A

See application file for complete search history.

(56) References Cited

U.S. PATENT DOCUMENTS 3,628,885 A * 12/1971 Sidenstick et al. ..... 416/217
4,184,900 A 1/1980 Erickson et al.
5,611,670 A 3/1997 Yoshinari et al.
5,649,806 A 7/1997 Scricca et al.
5,660,524 A * 8/1997 Lee et al. ..... 416/97 R
6,065,931 A * 5/2000 Suenaga et al. ..... 416/97 R
6,176,678 B1 * 1/2001 Brainch et al. ..... 416/97 R
6,193,465 B1 * 2/2001 Liotta et al. ..... 416/96 A
6,210,111 B1 4/2001 Liang
6,234,754 B1 5/2001 Zelesky et al.
6,341,939 B1 * 1/2002 Lee ..... 416/97 R
6,431,833 B2 * 8/2002 Jones ..... 416/97 R
6,461,108 B1 * 10/2002 Lee et al. ..... 416/96 R
6,506,020 B2 * 1/2003 Dailey ..... 416/96 R
6,506,022 B2 * 1/2003 Bunker ..... 416/97 R
6,514,042 B2 2/2003 Kvasnak et al.
6,634,859 B2 * 10/2003 Weigand et al. ..... 416/97 R
6,641,360 B2 * 11/2003 Beeck et al. ..... 415/1
6,824,359 B2 11/2004 Chlus et al.
2005/0169746 A1 * 8/2005 Fuller et al. ..... 415/115

* cited by examiner

*Primary Examiner*—Edward Look
*Assistant Examiner*—Aaron R Eastman
(74) *Attorney, Agent, or Firm*—Carlson, Gaskey & Olds

(57) ABSTRACT

A gas turbine blade assembly includes a neck defining a neck cavity, and has a first end and a second end at an opposite side relative to the first end. A platform has first and second sides. The first side is disposed on and faces the second end of the neck. An airfoil is supported on the second side of the platform. The neck, platform and airfoil define an inner cooling passage extending through the neck, platform and into the airfoil. The neck defines at least one core channel extending between the cooling passage and the neck cavity. The platform defines at least one film cooling channel extending from the first side facing the neck cavity to the second side disposed exterior to the airfoil to permit cooling air to flow through the inner cooling passage into the neck cavity and through the platform exterior to the airfoil.

19 Claims, 2 Drawing Sheets

FIG.1A
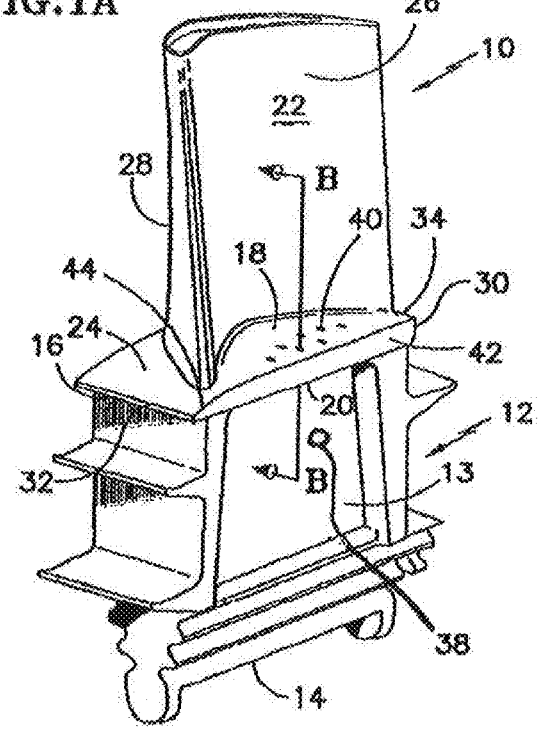
FIG.2
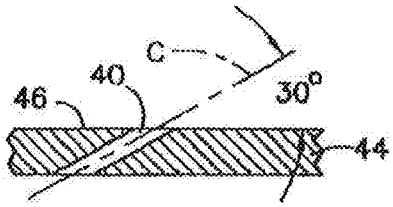
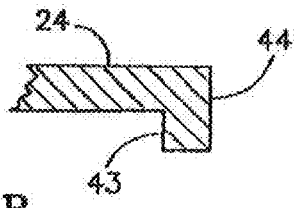
FIG.1B
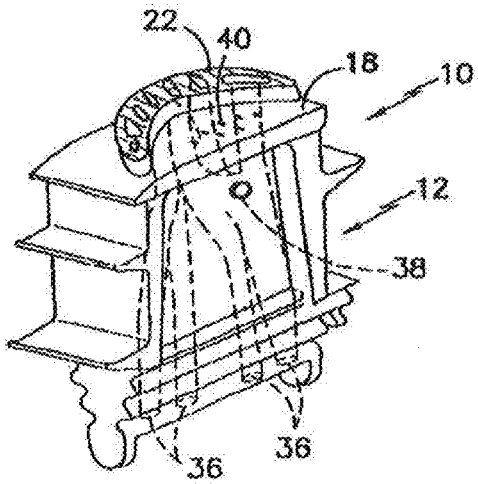
FIG.3

INDUSTRIAL GAS TURBINE BLADE ASSEMBLY

CROSS-REFERENCE TO RELATED APPLICATION

This application claims the benefit of U.S. Provisional Application No. 60/654,770, filed on Feb. 17, 2005, the disclosure of which is herein incorporated by reference in its entirety.

FIELD OF THE INVENTION

This invention relates generally to gas turbine engines, and more particularly to systems for cooling platforms and preventing cracking of the platforms of industrial gas turbine blades.

BACKGROUND OF THE INVENTION

Concave platforms of cooled industrial gas turbine (IGT) blades experience high metal temperature and thermal strain during operation. For example, the GE 7FA+e 1$^{st}$ stage turbine blade experiences severe thermo mechanical fatigue (TMF) initiated cracking at a leading edge and trailing edge of the platform that leads to high scrap rates and possible platform separation during operation. The crack results from a large, thin uncooled concave platform constrained by a relatively cooler airfoil and buttress structure that puts the platform in a state of high compressive strain at steady state operating conditions. The transient start-up condition results in a more severe compressive strain than steady state because of the large mass difference between the platform web and the rest of the component. Because of the mass difference the platform heats up more rapidly. Similarly the platform cools down more rapidly upon shutdown putting the platform into a tensile loading condition. The field parts also experience platform thermal barrier coating (TBC) spallation and significant platform oxidation.

Accordingly, it is an object of the present invention to provide a gas turbine blade assembly which overcomes the above-mentioned drawbacks and disadvantages.

SUMMARY OF THE INVENTION

In an aspect of the present invention, a gas turbine blade assembly includes a neck defining a neck cavity, and has a first end and a second end at an opposite side relative to the first end. The assembly further includes a platform having first and second sides. The first side of the platform is disposed on and faces the second end of the neck. An airfoil is supported on the second side of the platform. The neck, platform and airfoil define at least one inner cooling passage extending from the first end to the second end of the neck and through the platform and into the airfoil. The neck defines at least one core channel extending between the cooling passage and the neck cavity. The platform defines at least one film cooling channel extending from a portion of the first side facing the neck cavity to a portion of the second side disposed exterior to the airfoil to permit cooling air to flow through the inner cooling passage into the neck cavity and through a portion of the platform exterior to the airfoil.

BRIEF DESCRIPTION OF THE DRAWINGS

FIG. 1A is a perspective view of a platform for a gas turbine blade assembly in accordance with the present invention.

FIG. 1B is a cross-sectional view of the platform of FIG. 1A taken along the line B-B.

FIG. 2 is a cross-sectional view of the platform of FIG. 1A.

FIG. 3 is a perspective view of the platform of FIG. 1A showing inner cooling passages.

DETAILED DESCRIPTION OF THE PREFERRED EMBODIMENT

Figure 4:
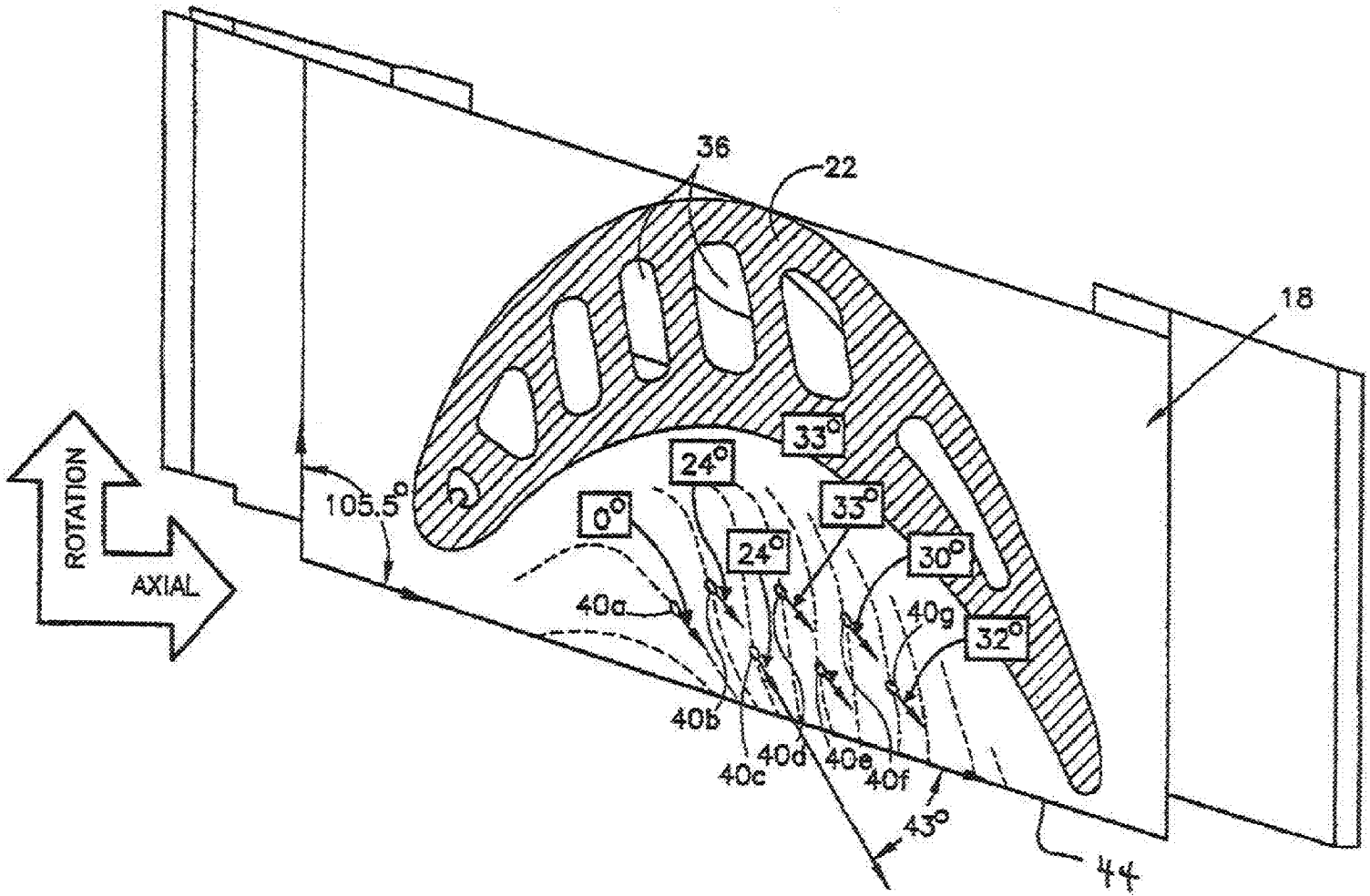
FIG. 4 is an enlarged perspective view of the platform of FIG. 1A.

With reference to FIGS. 1A and 1B, an industrial gas turbine engine blade assembly is indicated generally by the reference number 10. The assembly 10 includes a neck 12 defining a neck cavity 13, and has a base or first end 14 and a second end 16 at an opposite side relative to the base. The assembly 10 includes a concave platform 18 disposed along an upper portion of the neck 12, and has a first side 20 facing the second end 16 of the neck. The assembly 10 further includes an airfoil 22 supported on a second or opposite side 24 of the platform 18 relative to the neck 12 and extending outwardly from the platform. The airfoil 22 includes a concave side 26 and an oppositely facing convex side 28. The platform 18 has a rail structure 30 and includes a leading edge 32 and a trailing edge 34.

The neck 12, the platform 18 and the airfoil 22 cooperate to define at least one inner cooling passage—preferably a plurality of inner cooling passages 36 including leading edge and trailing edge cooling passages as shown in FIG. 3—extending therethrough from the base or first end 14 of the neck to the second end 16 and through the platform 18 and into the airfoil 22. The neck 12 also defines at least one and preferably a plurality of core channels 38 extending between the inner cooling passages 36 and the neck cavity 13. The core channels 38 are disposed on either the concave side 26 or the convex side 28 of the neck 12. A portion of the platform 18 disposed exterior and adjacent to either the concave side 26 or the convex side 28 of the airfoil 22 defines a plurality of film cooling channels 40 extending from a portion of the first side 20 of the platform 18 facing the neck cavity 13 to a portion of the second side 24 of the platform disposed exterior to the airfoil 22 to permit cooling air to flow through the inner cooling passages 36 into the neck cavity 13 and through a portion of the platform exterior to the airfoil.

In operation, the gas turbine blade assembly 10 in accordance with the present invention reduces the metal temperature and thermal strain in the platform 18 of the airfoil 22. The neck cavity 13 is pressurized via the core channel 38. The pressurized neck cavity 13 feeds the film cooling channels 40 to cool the platform 18. The cooled platform 18 also reduces platform oxidation and thermal barrier coating (TBC) spallation. This active platform cooling can be implemented to repair used industrial gas turbine blades and to extend the usable life of such blades by an additional overhaul cycle. The assembly 10 in accordance with the present invention can also be included as a beneficial feature in new or re-engineered industrial gas turbine blades.

In addition to actively cooling the platform 18, casting grain control can be employed to reduce the strain level in the platform. Industrial gas turbine blade directionally solidified (DS) castings tend to have a large single crystal (SC) grain for the entire platform area. This single crystal platform grain significantly increases the limiting strain level in the platform and the likelihood for thermo mechanical fatigue (TMF) crack initiation. The cracking also propagates along the large grain boundary. Casting parameters and processes can be used to control the platform grain and produce a more beneficial equiax grain state in the platform region without sacrificing the benefits of a directionally solidified grain in the airfoil. Grain control in accordance with the present invention can only apply to new or re-engineered industrial gas turbine blades.

The orientation of the core channel 38 preferably directs the flow of cooling air to impinge on an underside of the platform 18. A tube brazed into the core channel 38 and laid against the neck 12 could be used to direct core flow to impinge more effectively upon the underside of the platform 18. The core channels 38 could be created by machining or casting methods. In a particular GE 7FA+e 1$^{st}$ blade repair application, the core channel 38 is preferably 0.175 inches in diameter, pulls air from the inner cooling passage 36, has a circular shape, and extends between a trailing edge cooling passage 36 and the neck cavity 13 as shown in FIG. 3.

In an exemplary embodiment, the film cooling channels 40 defined by the platform 18 are an array of .015 inch-.050 inch diameter holes oriented to provide maximum convective and film cooling while minimizing stress concentrations. The number of film cooling channels 40 varies preferably from three to fifteen. The film cooling channels 40 extend through the concave platform 18 entering on an underside (the first side 20) of the platform and exiting at the platform flow path at the second side 24 thereof. An alternate location for the film cooling channels is through a rail 42 on a forward edge 44 of the concave platform, entering on a back side 43 of the rail and exiting on the edge of the concave platform (inside platform gap of assembled blades). With respect to a particular GE 7FA+e 1$^{st}$ blade repair application, the array of film cooling channels 40 includes seven .035 inch diameter holes extending through the platform 18 and oriented at an acute angle of about 30 degrees from a surface 46 of the platform and at an acute angle of about 30 degrees from the edge 44 of the platform. In another example, the acute angle is 43 degrees from the edge 44 (see FIG. 4). The angles shown relative to the dotted line represent the angle between the film cooling channels 40 and the primary gas flow (dotted lines).

Pressurized air from the neck cavity 13 can also be used to feed the film cooling channels exiting on the convex side 28 in order to cool other platform locations. A film cooling channel into the pressurized neck cavity could be used to purge a trailing edge undercut in a new or re-engineered industrial gas turbine blade as disclosed more fully in U.S. Ser. No. 10/738,288 filed on Dec. 17, 2003, the disclosure of which is herein incorporated by reference in its entirety.

An exemplary embodiment of the platform 18 is illustrated in FIG. 4. The platform 18 defines seven film cooling channels 40*a*, 40*b*, 40*c*, 40*d*, 40*e*, 40*f* and 40*g*. The film cooling channels are each about 0.035 inches in diameter, and are about 0.285 inches long (Length/Diameter=8.143). The surface angle of the film cooling channels 40 is about 30 degrees. The exit angle of the film cooling channels is about −30 degrees relative to the edge 44 of the platform 18. There are no diffusers at a film cooling channel exit, but diffusers could be used to improve cooling film effectiveness. The angles shown in FIG. 4 represent the angle between the hole injection angle and the angle of the primary gas flow (dotted lines).

As will be recognized by those of ordinary skill in the pertinent art, numerous modifications and substitutions can be made to the above-described embodiment of the present invention without departing from the scope of the invention. Accordingly, the preceding portion of this specification is to be taken in an illustrative, as opposed to a limiting sense.

What is claimed is:

1. A gas turbine blade assembly comprising:

a neck defining a neck cavity, and having a first end and a second end at an opposite side relative to the first end;

a platform having first and second sides, the first side being disposed on and facing the second end of the neck; and an airfoil supported on the second side of the platform, wherein the neck, the platform and the airfoil cooperate to define at least one inner cooling passage extending from the first end to the second end of the neck and through the platform and into the airfoil, the neck defining at least one core channel extending between the at least one cooling passage and the neck cavity, wherein a tube is brazed into the core channel and used to direct flow and effect impingement upon the underside of the platform, and the platform defining at least one film cooling channel extending from a portion of the first side facing the neck cavity to a portion of the second side disposed exterior to the airfoil to permit cooling air to flow through the at least one inner cooling passage into the neck cavity and through a portion of the platform exterior to the airfoil, wherein the at least one film cooling channel has a central longitudinal axis oriented to direct a flow of air toward a trailing edge of the airfoil at an angle of about 30 degrees or about 43 degrees relative to a forward edge of the platform, the forward edge on a same side as a concave side of the airfoil and extending between the trailing edge and a leading edge of the platform.

2. A gas turbine blade assembly as defined in claim 1, wherein the at least one inner cooling passage includes a trailing edge cooling passage extending into the trailing edge of the airfoil.

3. A gas turbine blade assembly as defined in claim 1, wherein the neck defining at least one core channel extending between the at least one cooling passage and the neck cavity, wherein the at least one core channel defined by the neck extends between the trailing edge cooling passage and the neck cavity.

4. A gas turbine blade assembly as defined in claim 3, wherein the at least one core channel is about 0.175 inches in diameter.

5. A gas turbine blade assembly as defined in claim 1, wherein the at least one film cooling channel is defined in a portion of the platform disposed exterior and adjacent to the concave side of the airfoil.

6. A gas turbine blade assembly as defined in claim 1, wherein the central longitudinal axis is oriented at an acute angle relative to the second side of the platform.

7. A gas turbine blade assembly—as defined in claim 6, wherein the central longitudinal axis is oriented at an angle of about 30 degrees relative to the second side of the platform.

8. A gas turbine blade assembly as defined in claim 1, wherein the angle is about 43 degrees.

9. A gas turbine engine as defined in claim 1, wherein the at least one film cooling channel is about 0.015 inches to about 0.50 inches in diameter.

10. A gas turbine engine as defined in claim 1, wherein the leading edge and the forward edge are oriented at an angle of about 105.5 degrees relative to one another.

11. A gas turbine blade assembly comprising:

a neck defining a neck cavity, and having a first end and a second end at an opposite side relative to the first end;

a platform having first and second sides, the first side being disposed on and facing the second end of the neck; and an airfoil supported on the second side of the platform, wherein the neck, the platform and the airfoil cooperate to define at least one inner cooling passage extending from the first end to the second end of the neck and through the platform and into the airfoil, the neck defining at least one core channel extending between the at least one cooling passage and the neck cavity, and the platform defining at least one film cooling channel extending from a portion of the first side facing the neck cavity to a portion of the second side disposed exterior to the airfoil to permit cooling air to flow through the at least one inner cooling passage into the neck cavity and through a portion of the platform exterior to the airfoil, wherein the at least one film cooling channel has a central longitudinal axis oriented to direct a flow of air toward a trailing edge of the airfoil wherein the trailing edge is at an acute angle relative to a forward edge of the platform, the forward edge on a same side as a concave side of the airfoil and extending between the trailing edge and a leading edge of the platform, the at least one film cooling channel is greater than 0.015 inches to about 0.050 inches in diameter and wherein the at least one film cooling channel is oriented at an angle of between 0 and 33 degrees relative to a gas flow on the concave side.

12. A gas turbine blade assembly as defined in claim 11, wherein the at least one film cooling channel is about 0.035 inches in diameter.

13. A gas turbine blade assembly as defined in claim 12, wherein the at least one film cooling channel includes three to fifteen film cooling channels.

14. A gas turbine blade assembly as defined in claim 13, wherein the at least one film cooling channel includes seven film cooling channels.

15. A gas turbine blade assembly as defined in claim 12, wherein the at least one film cooling channel is about 0.285 inches in length.

16. A gas turbine engine as defined in claim 11, wherein the at least one film cooling channel is oriented at an angle of about 30 degrees relative to the second side of the platform.

17. A gas turbine blade assembly as defined in claim 11, wherein the at least one film cooling channel has a length, and a length/diameter ratio of approximately 8.143.

18. A gas turbine blade assembly as defined in claim 11, wherein the neck defining at least one core channel extending between the at least one cooling passage and the neck cavity, wherein the at least one core channel defined by the neck extends between the trailing edge cooling passage and the neck cavity.

19. A gas turbine blade assembly comprising:

a neck defining a neck cavity, and having a first end and a second end at an opposite side relative to the first end;

a platform having first and second sides, the first side being disposed on and facing the second end of the neck; and an airfoil supported on the second side of the platform, wherein the neck, the platform and the airfoil cooperate to define at least one inner cooling passage extending from the first end to the second end of the neck and through the platform and into the airfoil, the neck defining at least one core channel extending between the at least one cooling passage and the neck cavity, and the platform defining at least one film cooling channel extending from a portion of the first side facing the neck cavity to a portion of the second side disposed exterior to the airfoil to permit cooling air to flow through the at least one inner cooling passage into the neck cavity and through a portion of the platform exterior to the airfoil, wherein the at least one film cooling channel has a central longitudinal axis oriented to direct a flow of air toward a trailing edge of the airfoil wherein the trailing edge is at an angle to a forward edge of the platform, the forward edge on a same side as a concave side of the airfoil and extending between the trailing edge and a leading edge of the platform, the concave side configured to provide a primary gas flow, the angle of the central longitudinal axis is between 0 and 33 degrees relative to the primary gas flow at the location of the at least one film cooling channel.

* * * * *